US007139624B2

(12) United States Patent
Terada et al.

(10) Patent No.: US 7,139,624 B2
(45) Date of Patent: Nov. 21, 2006

(54) AUDIO SIGNAL PROCESSING DEVICE

(75) Inventors: Kotaro Terada, Hamamatsu (JP); Takamitsu Aoki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 714 days.

(21) Appl. No.: 10/613,149

(22) Filed: Jul. 3, 2003

(65) Prior Publication Data

US 2004/0010331 A1 Jan. 15, 2004

(30) Foreign Application Priority Data

Jul. 10, 2002 (JP) ..... 2002-201517

(51) Int. Cl.
*H04H 7/00* (2006.01)

(52) U.S. Cl. ..... 700/94; 381/119; 711/155

(58) Field of Classification Search ..... 711/155
See application file for complete search history.

(56) References Cited

U.S. PATENT DOCUMENTS 4,275,268 A * 6/1981 Takahashi et al. ..... 381/119
4,479,240 A * 10/1984 McKinley, Jr. ..... 381/119
6,839,441 B1 * 1/2005 Powers et al. ..... 381/119
2002/0156547 A1 10/2002 Suyama et al.

* cited by examiner

*Primary Examiner*—Daniel Swerdlow
(74) *Attorney, Agent, or Firm*—Morrison & Foerster LLP

(57) ABSTRACT

In an audio signal processing device which processes audio signals and outputs the audio signals, a memory for storing current data being setting data representing a current status of the device, a controller for controlling the device based on the current data, and a memory for storing the setting data as primary setting data and secondary setting data linked from the primary setting data, are provided so that when the setting data is stored, an automatic save can be executed by automatically setting a save destination of secondary setting data linked from primary setting data and storing the data therein. The device is configured such that an auto store key for directing execution of an automatic save, and a save destination (display boxes) of the secondary setting data when the automatic save is directed, are displayed on the display. Additionally, it is preferable to allow the device to execute also a manual save by accepting a setting of a save destination of secondary setting data and storing the secondary setting data in the accepted save destination.

14 Claims, 10 Drawing Sheets

AUDIO SIGNAL PROCESSING DEVICE

BACKGROUND OF THE INVENTION

1. Field of the Invention

The invention relates to an audio signal processing device composed of a mixer, an effecter, a recorder, a synthesizer, and combination thereof, which optionally processes inputted audio signals and outputs the audio signals.

2. Description of the Related Art

Conventionally, digital mixers for controlling audio systems at places, for example, for concerts, plays, and so on have been known as audio signal processing devices which optionally process inputted audio signals and output the audio signals. In such places, many microphones and many speakers are used to provide a variety of sound effects and so on, in which the digital mixer controls in a centralized manner how to mix many inputs, how to apply such effects, to which output system to output them, and so on. In other words, the digital mixer performs mixing, equalizing, and so on, in accordance with a setting, for audio signals of voice inputted through the microphones and outputs the audio signals to the speakers.

The setting, however, should be done over a wide range such as a mixing status, a patch status, names of switches, kinds of boards used for input and output, and so on, leading to difficult setting operations when and where required. Hence, several required settings are stored in advance as "scenes", so that a required scene is selected and loaded from among the stored ones to reproduce a required setting status at a required situation.

The applicant of the application has filed an application (JP, 2002-319915, A, and US 2002/0156547, A1). In an example of a digital mixer according to this application, setting information representing a setting status is composed of primary setting data including a setting of each input channel, a setting of each output channel, a setting of an internal effector, a setting of an internal equalizer, and a setting of a monitor; and secondary setting data, which is specified by link information included in the primary setting data, including patch data representing a patch status of mixing processing on the input side and output side, name data being data representing the corresponding between each channel and a name assigned thereto, and unit data being setting data for each input of an input board and setting data for each output of an output board. Plural secondary setting data can be stored as a library, and link information to secondary setting data for use is included in primary setting data for each scene.

As described above, storage of the setting data, divided in primary setting data that is often modified for each scene and secondary setting data that are rarely modified, allows common secondary setting data to be used for different primary setting data, which can reduce the amount of the setting data. Besides, even when a new scene is loaded, a load operation is not necessary for portions having common secondary setting data, which can increase the response efficiency at loading the setting data.

There is, however, a problem that in an audio signal processing device including such a digital mixer, entire modification of setting data is a troublesome operation because storage of the modified setting data requires specification of a save destination of each secondary setting data as well as a save destination of the primary setting data. This problem becomes more prominent when a name is set on the primary setting data or secondary setting data.

SUMMARY OF THE INVENTION

It is an object of the present invention to solve the above-described problems to improve the operability in directing storage of setting data in an audio signal processing device that stores setting data as primary setting data and secondary setting data linked from the primary setting data.

In order to achieve the above object, the invention is an audio signal processing device which processes audio signals and outputs the audio signals, including: a first memory for storing current data being setting data representing a current status of the device; a controller for controlling the device based on the current data; a second memory for storing the setting data as primary setting data and secondary setting data linked from the primary setting data; an automatic saver for executing an automatic save, when storing the setting data in the second memory, by storing the primary setting data in a specified save destination in the second memory, and by automatically setting a save destination for data to be newly stored among the secondary setting data linked from the primary setting data and storing the data in the second memory; a manual saver for executing a manual save, when storing the setting data in the second memory, by storing the primary setting data in a specified save destination in the second memory, and by accepting a setting of a save destination for data to be newly stored among the secondary setting data linked from the primary setting data and storing the data in the accepted save destination in the second memory; an automatic save switch for directing execution of the automatic save; and a manual save switch for directing execution of the manual save.

Such an audio signal processing device preferably includes a display; and a display controller for causing the display to display on a same display screen the automatic save switch and the save destination of the secondary setting data when the automatic save is directed.

Alternatively, it is also adoptable to provide a display; and a display controller for causing the display to display the save destination of the secondary setting data when the automatic save and/or the manual save are/is directed, wherein the display is performed in a different form, depending on whether or not the secondary setting data is to be newly stored.

Besides, a different save destination may be displayed as the save destination of the secondary setting data, in accordance with whether the specified save destination of the primary setting data is new or existing.

Alternatively, one of unoccupied save destinations may be displayed as a save destination when the automatic save is directed, and information that the save destination is undetermined may be displayed instead of a save destination when the manual save is directed, for secondary setting data to be newly stored.

Besides, the invention is an audio signal processing device which processes audio signals and outputs the audio signals, including: a display; a first memory for storing current data being setting data representing a current status of the device; a controller for controlling the device based on the current data; a second memory for storing the setting data as primary setting data and secondary setting data linked from the primary setting data; an automatic saver for executing an automatic save, when storing the setting data in the second memory, by storing the primary setting data in a specified save destination in the second memory, and by automatically setting a save destination for data to be newly stored among the secondary setting data linked from the primary setting data and storing the data in the second memory; and a display controller for causing the display to display the automatic save switch for directing execution of the automatic save and a save destination of the secondary setting data when the automatic save is directed.

Such an audio signal processing device preferably includes a specification acceptor for accepting specification of a name of the primary setting data; and a setting executor for setting, when the name of the primary setting data is specified, a name of secondary setting data to be stored in the automatically set save destination identical to the name of the primary setting data being a target of the automatic save.

Besides, when the display displays the save destination of the secondary setting data, the destination may be displayed in a different form, depending on whether or not the secondary setting data is to be newly stored.

Alternatively, when the display displays the save destination of the secondary setting data, a different save destination may be displayed, in accordance with whether the specified save destination of the primary setting data is new or existing.

Alternatively, when the display displays the save destination of the secondary setting data, one of unoccupied save destinations may be displayed as a save destination for secondary setting data to be newly stored.

In above described audio signal processing devices, it is also possible that, in the case of the specified save destination of the primary setting data being existing, save destination of the secondary setting data to be newly stored is set at a destination from which a secondary setting data linked from the primary setting data is loaded.

Alternatively, the data to be newly stored among the secondary setting data may be one which has been modified before it is stored in the second memory among the secondary setting data stored in the first memory.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, preferred embodiments of the invention will be described with reference to the drawings.

Figure 1:
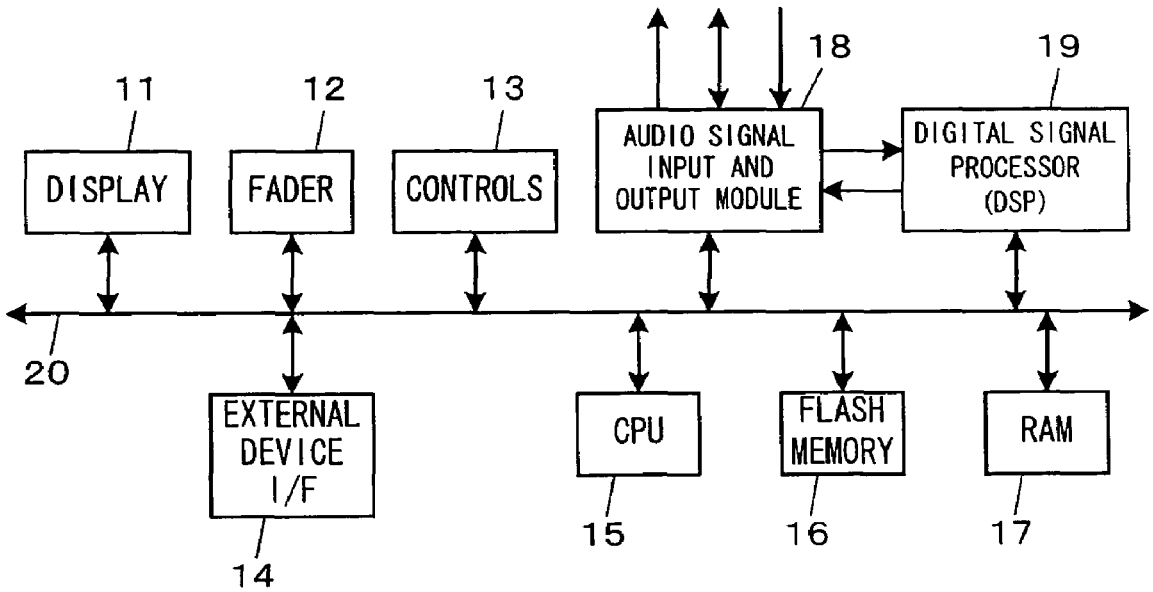
FIG. 1 is a block diagram showing a schematic configuration of a digital mixer being an embodiment of an audio signal processing device of the invention.
Figure 2:
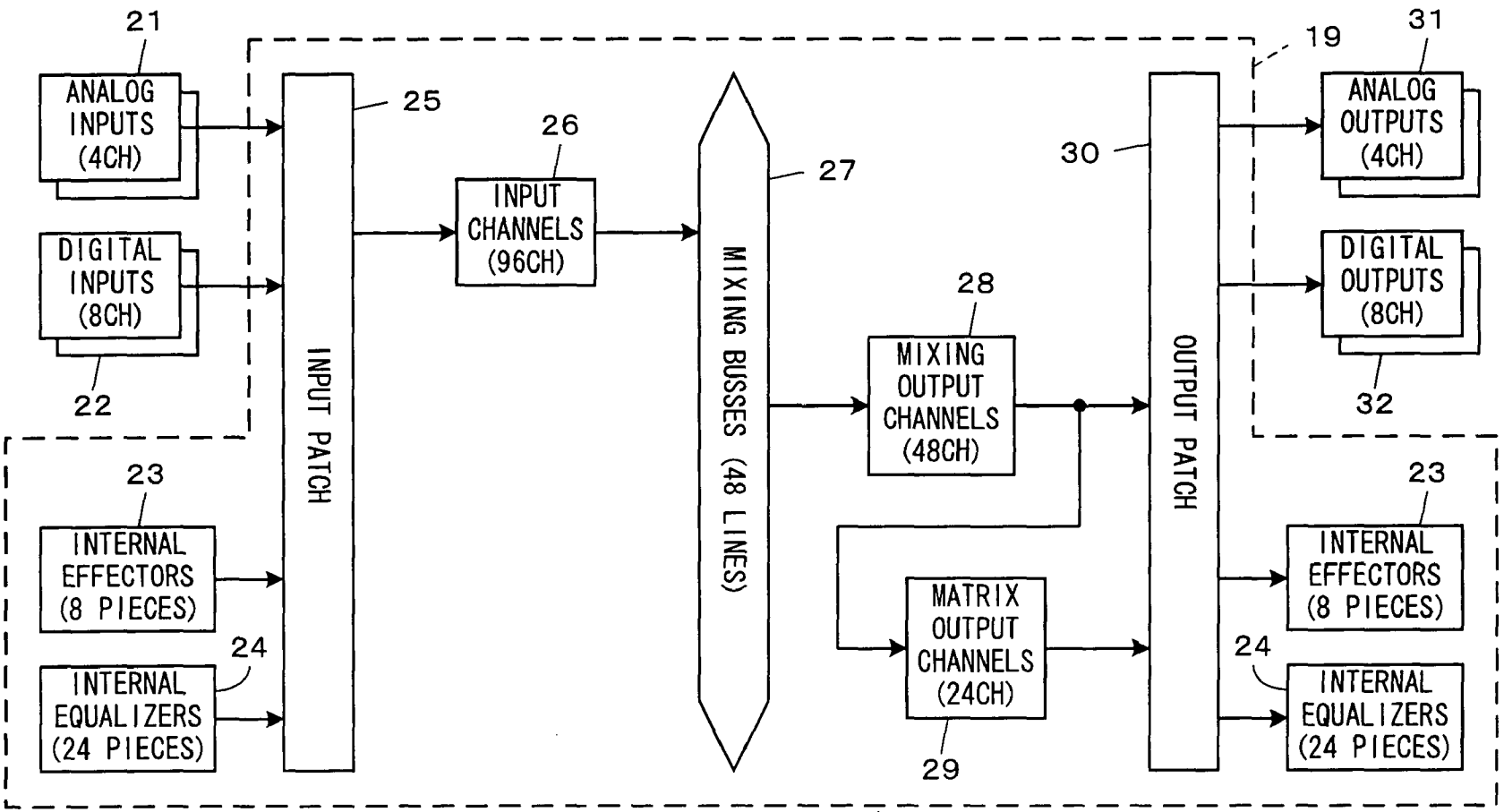
FIG. 2 is a block diagram showing in more detail the configuration of a DSP shown in FIG. 1.

A configuration of a digital mixer being an embodiment of an audio signal processing device of the invention will be described first using FIG. 1 and FIG. 2. FIG. 1 is a block diagram showing a schematic configuration of the digital mixer, and FIG. 2 is a block diagram showing in more detail the configuration of the DSP shown in FIG. 1.

The digital mixer (hereafter, also referred to only as a "mixer") is an audio signal processing device which processes audio signals and outputs the audio signals. As shown in FIG. 1, the device includes a display 11, faders 12, controls 13, an external device interface (I/F) 14, a CPU 15, a flash memory 16, a RAM 17, an audio signal input and output module 18, a digital signal processor (DSP) 19, which are connected by a system bus 20.

The display 11, which is a display composed of a liquid crystal display (LCD) or the like, is constituted of a display which displays a screen for referring to, modifying, saving, and so on settings of the mixer, an operating status of the device, and so on; a display which is provided for a row of control group constituted of a fader, knobs, switches, and so on to display the name of a channel to be controlled by the row of control group; and so on.

The faders 12 and controls 13 are provided on a panel of the mixer for a user to set parameters in processing audio signals. The faders 12 of them have a motor to be movable to designated positions also by a direction from the CPU 15.

The external device I/F 14 is an interface for transferring information with external devices such as a personal computer and the like connected to the mixer.

The CPU 15, which is a controller that comprehensively controls operation of the whole mixer, executes a predetermined program stored in the flash memory 16 to detect operations at the faders 12 and controls 13 and take actions in accordance with the operations, and to control the action of the DSP 19, the display contents of the display 11, the positions of the faders 12, and so on in accordance with later-described setting data. It should be noted that the control is conducted based on later-described current data.

The flash memory 16 is a rewritable non-volatile memory that stores a control program and so on executed by the CPU 15. The flash memory 16 also stores, in accordance with a direction by a user, a later-described library of setting data, which is usually stored on the RAM 17 and provided for editing.

The RAM 17 is a memory that functions as a current memory being a first memory to store current data, functions as a setting data memory being a second memory to store the later-described library of setting data, and is used as a work memory of the CPU 15. As matter of course, the RAM 17 can accomplish these functions at the same time.

The current data here is setting data representing the current status of the mixer, that is, reflected in the current control. Based on the current data, the CPU 15 controls the display contents of the display 11, the positions of the faders 12, and the setting statuses of the controls 13 on the panel, the algorithm and parameters of mixing processing for audio signals in the DSP 19, and the like.

The audio signal input and output module 18 is an interface for receiving input of audio signals to be processed in the DSP 19 and outputting processed audio signals. A plurality of A/D conversion boards each capable of analog input of four channels, D/A conversion boards each capable of analog output of four channels, and digital input and output boards each capable of digital input and output of eight channels, can be installed in combination into the audio signal input and output module 18, which actually inputs and outputs signals through the boards.

The DSP 19 includes, for executing mixing processing, as shown in FIG. 2, internal effectors 23, internal equalizers 24, an input patch 25, input channels 26, mixing busses 27, mixing output channels 28, matrix output channels 29, and an output patch 30. Analog inputs 21, digital inputs 22, analog outputs 31, and digital outputs 32 represent input and output channels implemented by the above-described boards to be installed into the audio signal input and output unit 18.

The internal effectors 23 are composed of plural blocks of effectors that apply selected effects to inputted signals and output the signals. The channel configuration of the internal effector 23 is changeable between monaural, stereo, and so on. The internal equalizers 24 represent 24 pieces of equalizers built in the mixer. Each of the equalizers inputs and equalizes a single signal and outputs a single signal.

The input patch 25 performs optional patch for assigning to the input channels 26, having 96 channels, signals inputted from the inputs of the analog inputs 21 and digital inputs 22, the internal effectors 23, and the internal equalizers 24. A user can perform a setting of the input patch 25 while viewing a predetermined screen, so that input signals assigned by the input patch 25 are inputted into respective input channels 26.

Each of the input channels 26 includes a limiter, a compressor, an equalizer, a fader, a pan, an output destination selection module, an output level adjustment module, and so on to perform predetermined processing for inputted signals and output the processed signals to a mixing bus selected by the output destination selection module among the mixing busses 27 having 48 busses. In this event, it is possible to output to plural mixing busses 27, and also to output from plural input channels 26 to one mixing bus 27.

The signal inputted to the mixing bus 27 is outputted to a corresponding mixing output channel 28. In this event, a mixing bus 27, into which signals are inputted from plural input channels 26, performs mixing processing for the signals.

Forty-eight mixing output channels 28 are provided to correspond to the mixing busses on a one-to-one basis. Each of the channels includes a limiter, a compressor, an equalizer, a fader, and so on. The mixing output channel 28 performs predetermined processing for signals inputted from the corresponding mixing bus and outputs the processed signals to the matrix output channel 29 or output patch 30.

Twenty-four matrix output channels 29 are provided, and each can receive the output signals from optionally selected mixing output channel 28 to further mix the signals and output them. The signal processing of the equalizer or the like is similar in configuration to the mixing output channel, and the output of the matrix output channel 29 is inputted to the output patch 30.

The output patch 30 performs optional patch for assigning the signals inputted from the mixing output channels 28 and matrix output channels 29 to outputs of the analog outputs 31 and digital outputs 32, the internal effectors 23, and the internal equalizers 24. The user can perform also the setting of the output patch 30 while viewing a predetermined screen, so that the signal from one output channel can be assigned even to plural outputs. The signals assigned to the analog outputs 31 or digital outputs 32 are outputted therefrom, and the signals assigned to the internal effectors 23 or internal equalizers 24 are processed therein and then inputted again into the input patch 25.

The DSP 19 shown in FIG. 1 has the above-described configuration to perform processings such as mixing, equalizing, and so on for inputted audio signals. The DSP 19 can also mix signals selected from the input channels 26 and the output channels 28 and 29 and output the mixed signal to an output for monitoring.

It should be noted that in FIG. 2, inputs such as an input on a console side and a talk-back in, outputs such as an output on the console side and a cue out, a connection for an insert effect, and a connection for monitoring output, are omitted for simplification of the drawing.

Figure 3:
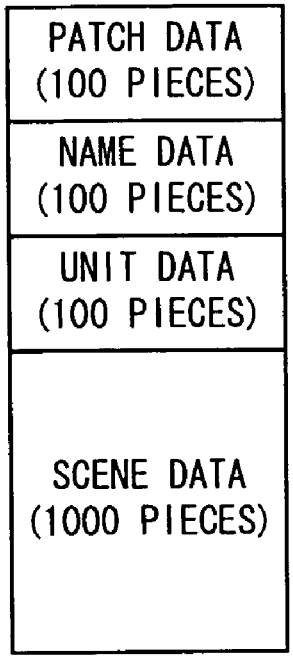
FIG. 3 is a view for explaining a configuration and a storage status of setting data in the digital mixer shown in FIG. 1.
Figure 4:
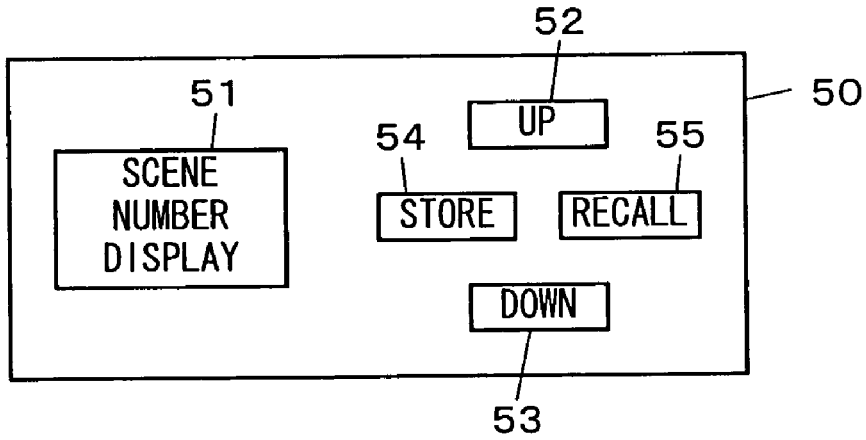
FIG. 4 is a view showing a configuration of an operation module for directing to save and load the setting data.

The setting data memory capable of storing as scenes a plurality of current data in the current memory in the digital mixer as described above will be explained next using FIG. 3 and FIG. 4. FIG. 3 is a view for explaining a configuration and a storage status of the setting data, and FIG. 4 is a view showing a configuration of an operation module for directing a save and load of the setting data.

As is clear from the configuration of the mixing processing by the above-described DSP 19, items to be set for causing the mixer to perform desired actions include very many things such as the patch statuses of the input patch 25 and output patch 30, parameters of the limiter, compressor, equalizer, and so on in each input channel 26, channel names of the input channel 26, mixing output channel 28, and matrix output channel 29, and so on.

Hence, several setting data are stored in the setting data memory on the RAM 17 in a manner that one setting data on a series of settings as a scene is associated with a scene number, so that setting data can be loaded into the current memory by specifying its scene number to reproduce a required setting status at a situation where it is required. Further, an often modified portion of setting data is defined as primary setting data, and a rarely modified portion is defined as secondary setting data, with link information to required secondary setting data being included in the primary setting data, to reduce the storage capacity required for saving the setting data and improve the response at loading and saving the setting data.

In the mixer, patch data representing patch statuses of the input patch 25 and output patch 30, name data representing names of channels such as the input channels 26, mixing output channels 28, and matrix output channels 29, and unit data representing settings of the gain, polarity, and so on of each input/output of the input/output boards installed in the audio signal input and output module 18, are defined as the secondary setting data, and setting data other than these data and link information to these secondary setting data are defined as scene data being the primary setting data.

In other words, one scene is composed of the scene data, and the patch data, the name data, and the matrix data which are obtained by following the link information included in the scene data. The setting data memory on the RAM 17 has, as shown in FIG. 3, a region where 100 pieces of patch data, name data, and unit data respectively are stored as a library, and 1000 pieces of scene data are stored. Numbers assigned to respective data are used to specify save destinations.

The contents of the setting data memory can be saved in the flash memory 16 in response to a save direction by the user, and conversely, the contents of each library and scene data saved in the flash memory 16 can be loaded into the setting data memory on the RAM 17 in response to a load direction by the user. These actions, which are actions different from later-described loading and saving of each scene, is designed because the flash memory 16 is limited in number of rewrites, in which each scene can be edited in detail while scene data is stored in the setting data memory on the RAM 17, all required scenes can be edited, and then the final results can be stored into the flash memory 16.

The load and save of a scene are directed by an operation module 50 shown in FIG. 4. The operation module 50 is provided on the panel of the mixer, a scene number display 51 is a part of the display 11 shown in FIG. 1, and keys 52 to 55 are parts of the controls 13.

The scene number display 51, which is a display that displays in three digits the number of a scene to be a load target or a save destination, changes numbers in an ascending order when the up-key 52 is pressed and in a descending order when the down-key 53 is pressed. When a desired number is selected by the keys and then the recall key 55 is pressed, a scene of the number is loaded from the setting data memory on the RAM 17 and stored as current data in the current memory on the same RAM 17, thereby accomplishing a load. In accordance with data of the scene, the mixing processing by the DSP 19 is controlled, and the display data on the display 11 and the positions of the faders 12 are modified.

When the faders 12 and controls 13 are operated after the display on the display 11 and the positions of faders 12 are once modified, the current data is modified accompanying the operation, whereby the mixing processing by the DSP 19 is controlled. Accordingly, the scene can be edited by the operation of the faders 12 and controls 13. Upon a press of the store key 54, the current data at the point of time is stored and saved, as a scene of the selected number, in the setting data memory.

These processings such as loading, editing, and saving the scene are performed by control of the CPU 15.

Figure 5:
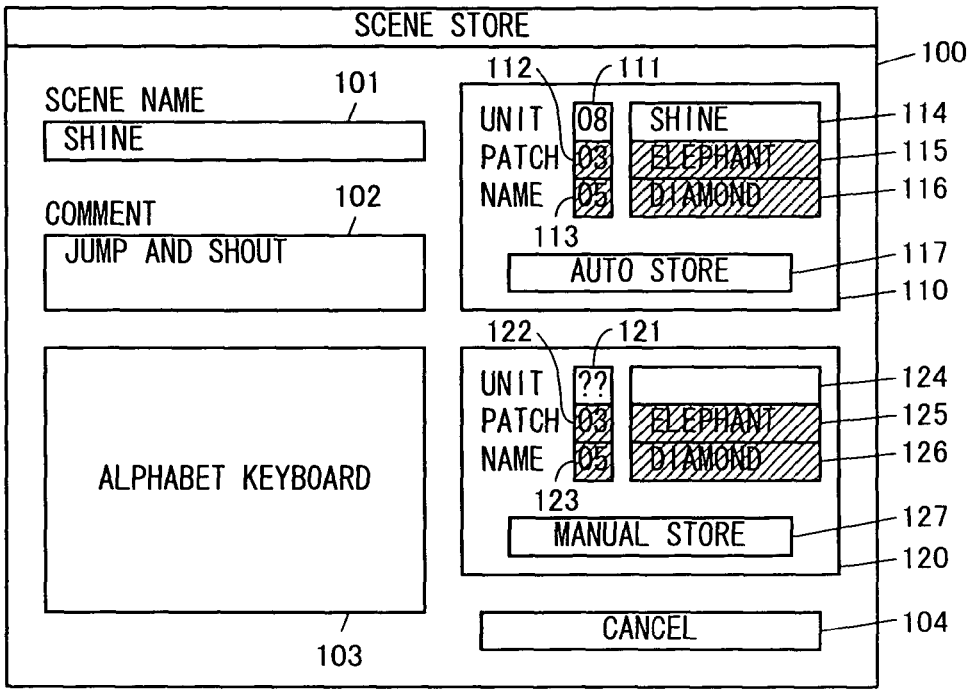
FIG. 5 and FIG. 6 are views showing different display examples of screens for directing to save a scene in the digital mixer shown in FIG. 1, respectively.
Figure 6:
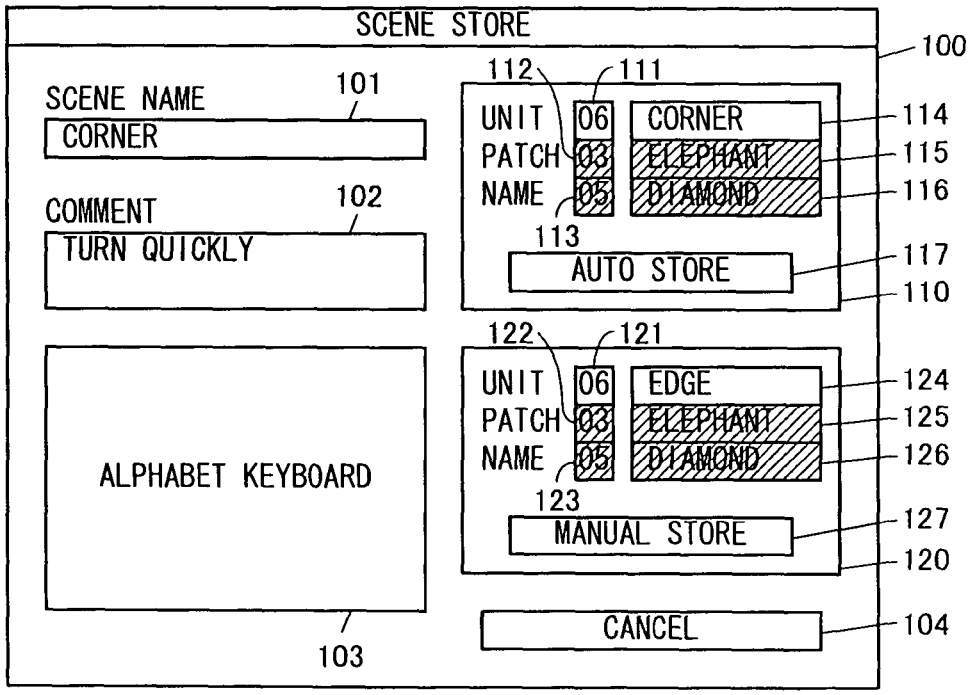
Figure 7:
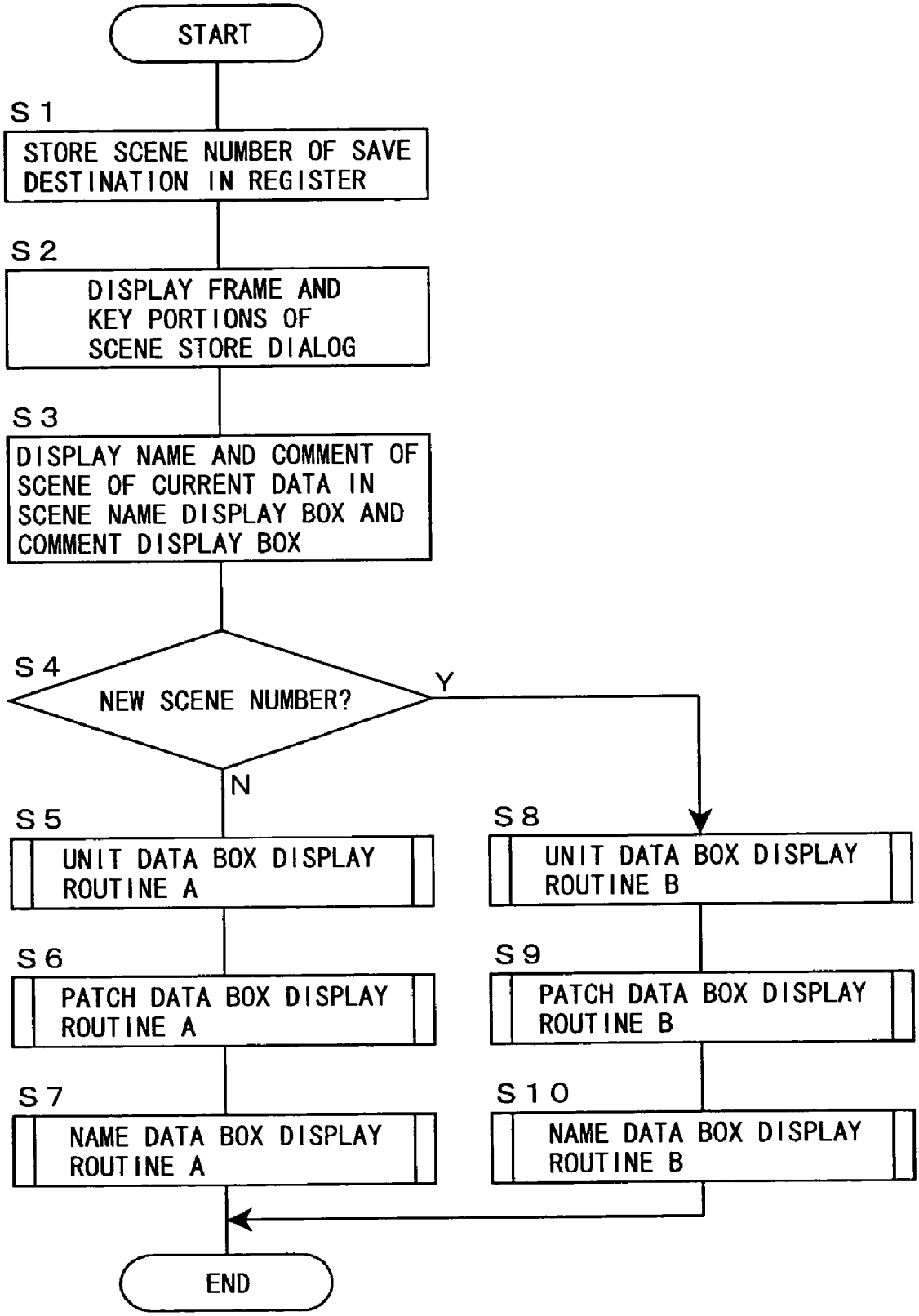
FIG. 7 is a flowchart showing processing of displaying the screens shown in FIG. 5 and FIG. 6.
Figure 8:
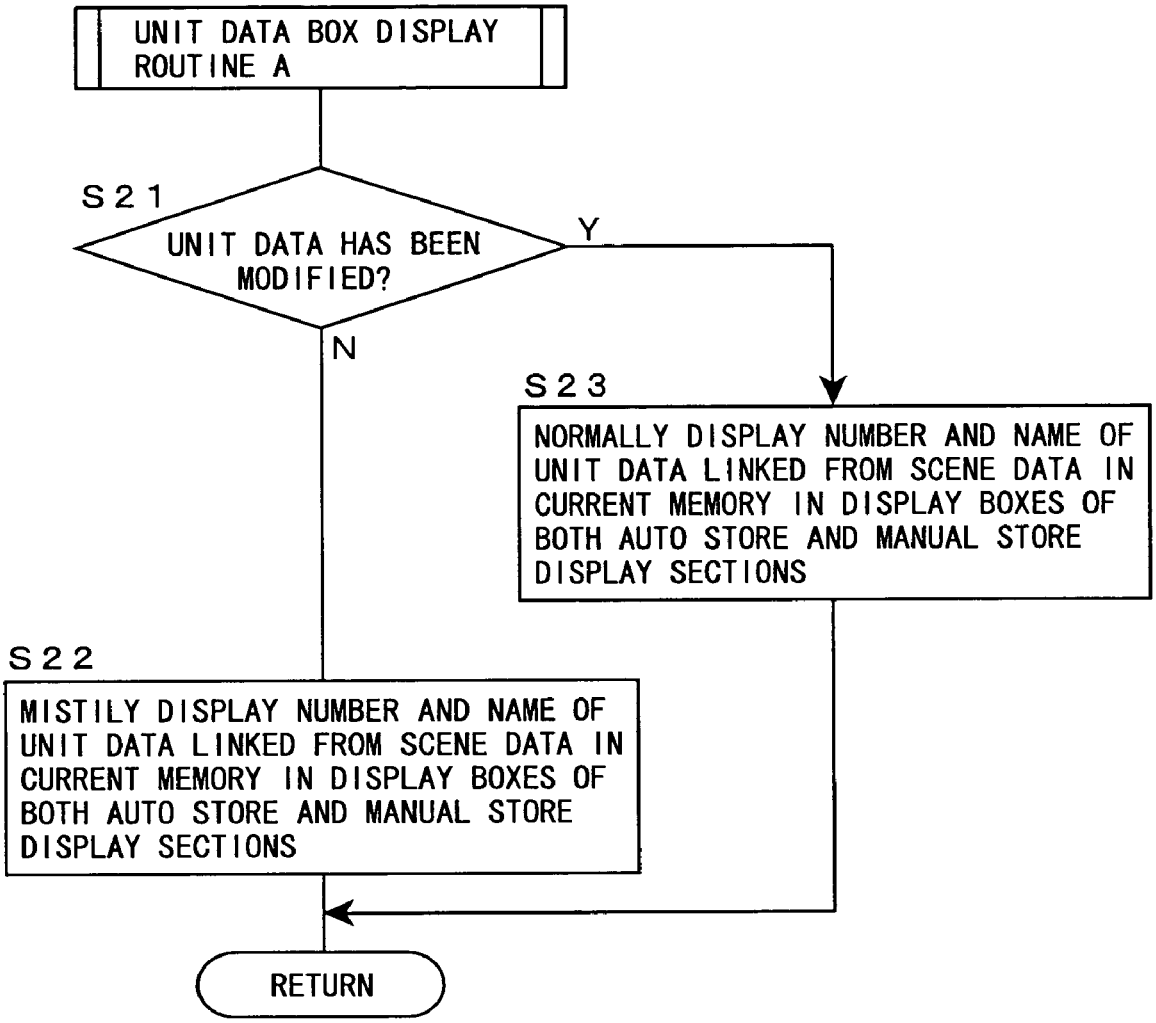
FIG. 8 is a flowchart showing processing of unit data box display routine A shown in FIG. 7.
Figure 9:
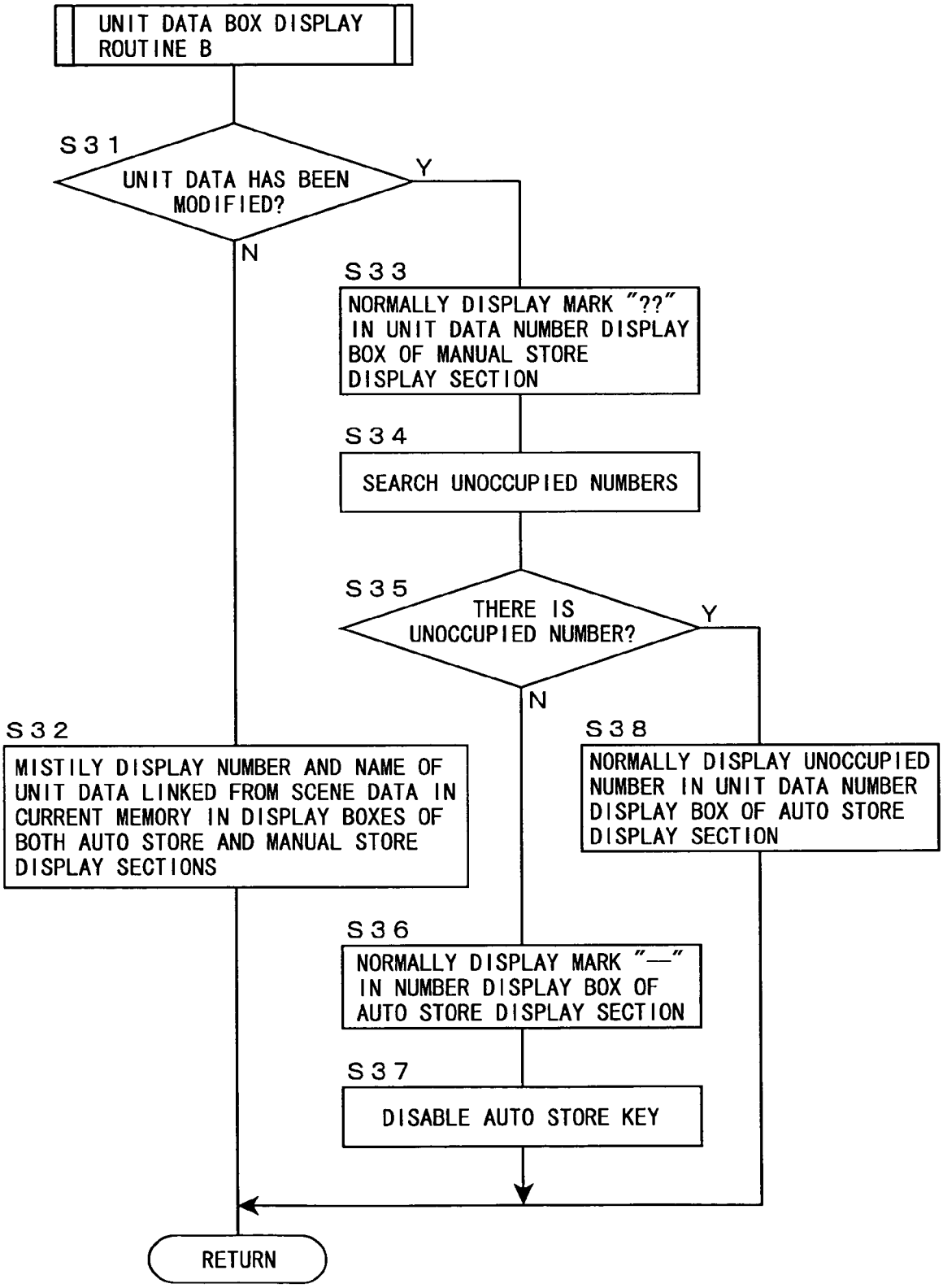
FIG. 9 is a flowchart showing processing of unit data box display routine B shown in FIG. 7.
Figure 10:
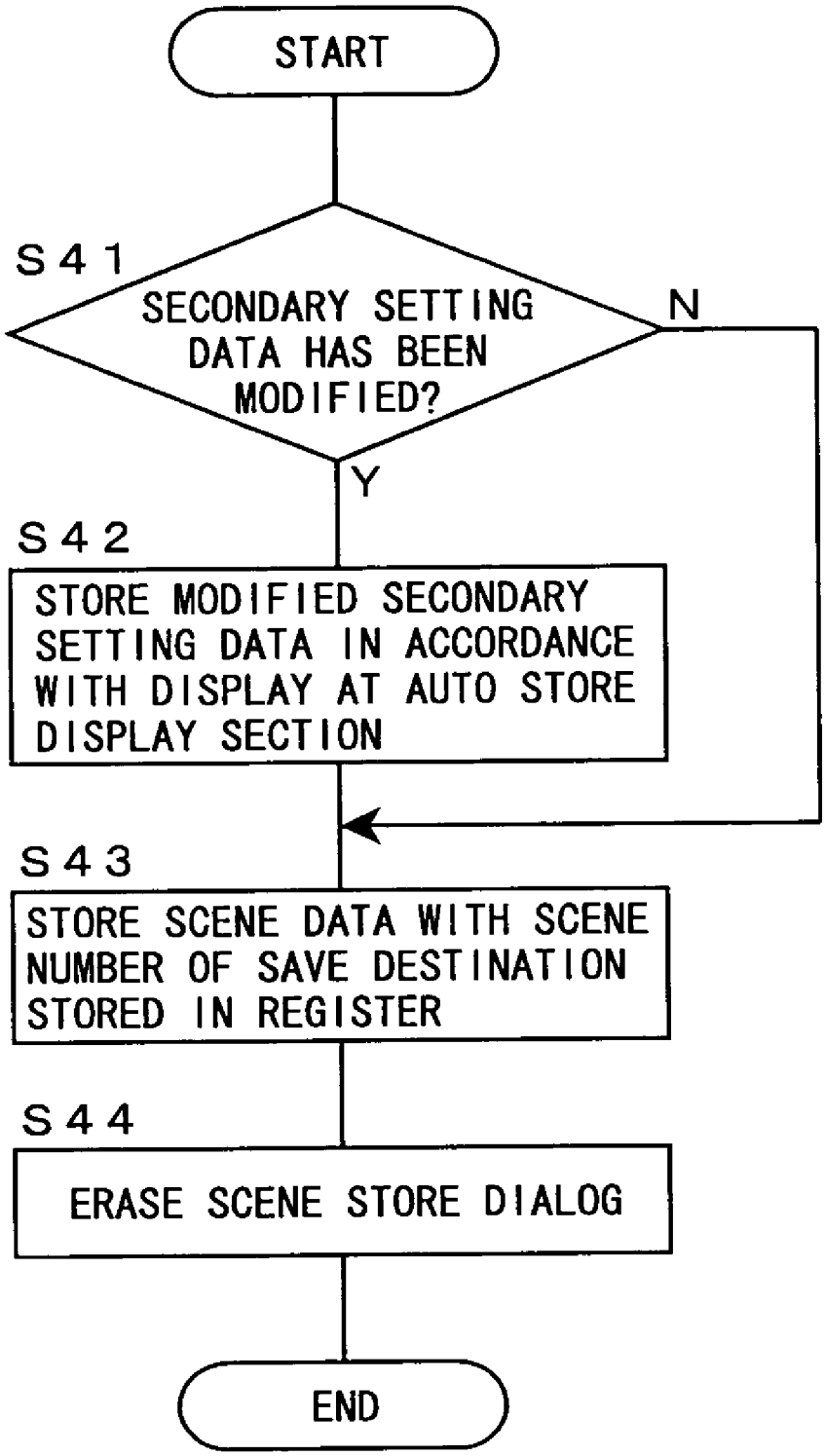
FIG. 10 is a flowchart showing processing of automatic save of a scene in the digital mixer shown in FIG. 1.
Figure 11:
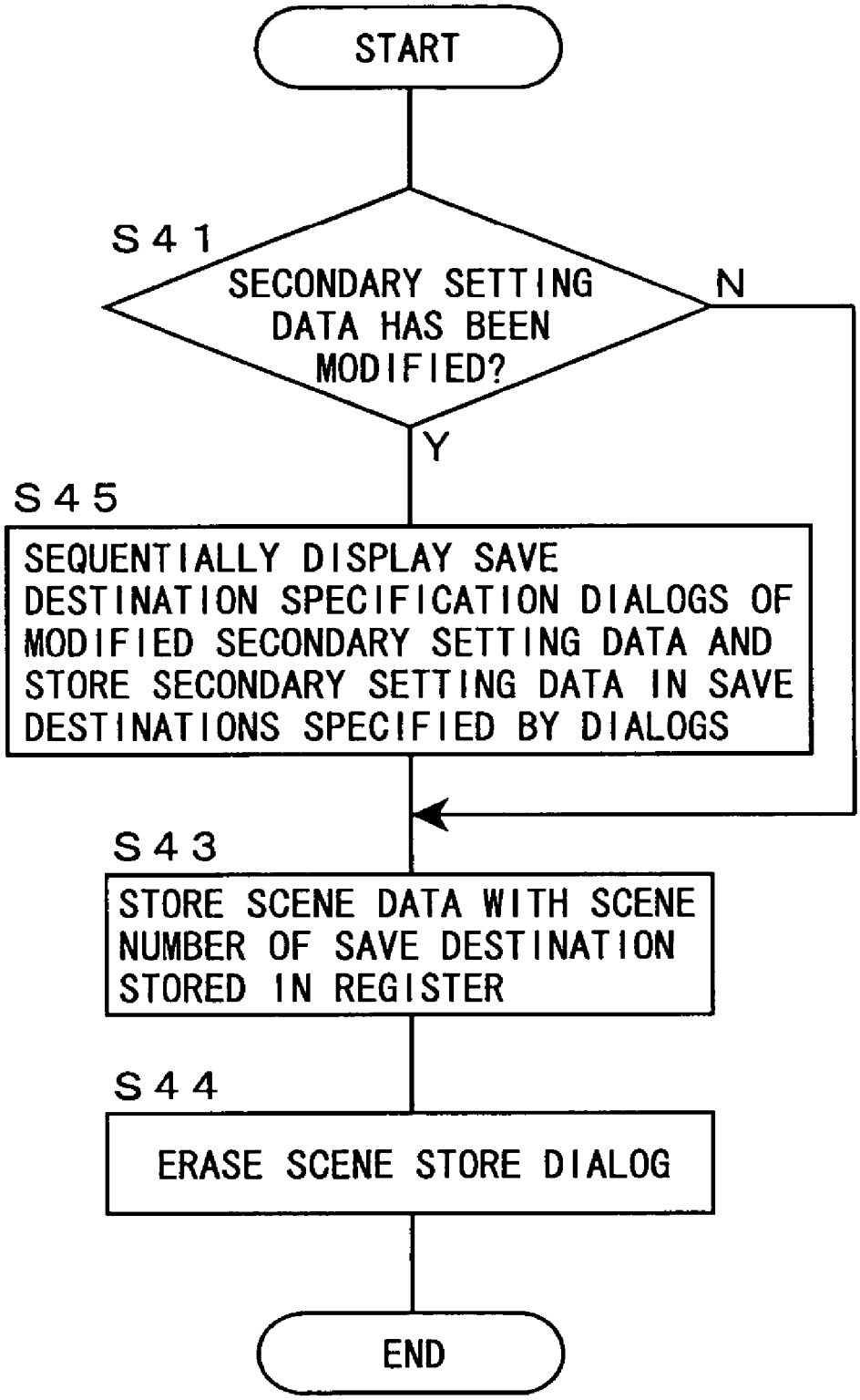
FIG. 11 is a flowchart showing processing of manual save of the same.
Figure 12:
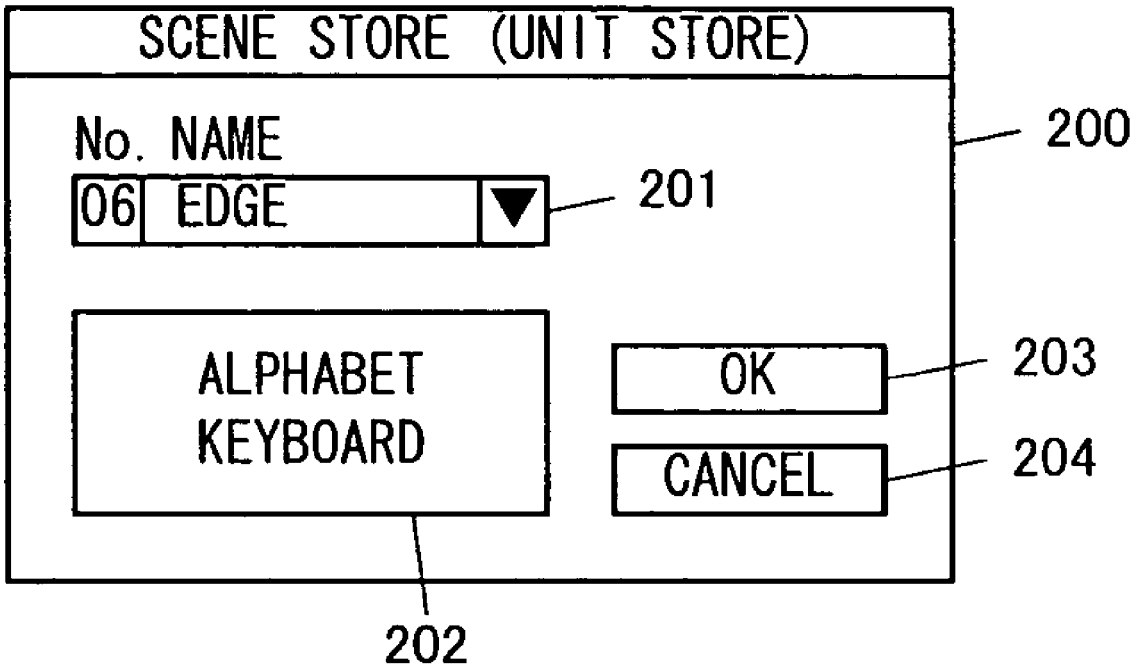
FIG. 12 is a view showing a display example of a save destination specification dialog displayed by the processing in FIG. 11.

The feature of the invention is the processing of saving the scene, which will be explained further also using FIG. 5 to FIG. 12. FIG. 5 and FIG. 6 are views showing display examples of screens for directing to save a scene respectively, FIG. 7 is a flowchart showing processing of displaying the screens shown in FIG. 5 and FIG. 6, FIG. 8 is a flowchart showing processing of unit data box display routine A shown in FIG. 7, FIG. 9 is a flowchart showing processing of unit data box display routine B shown in FIG. 7, FIG. 10 is a flowchart showing processing of automatic save of a scene in the digital mixer, FIG. 11 is a flowchart showing processing of manual save of the same, and FIG. 12 is a view showing a display example of a save destination specification dialog displayed by the processing in FIG. 11.

In the digital mixer, it is possible to perform, when saving a scene, an automatic save by storing scene data in a save destination specified by a scene number, and by automatically setting a save destination for data to be newly stored among secondary setting data linked from the scene data and storing the data therein; and a manual save by storing scene data in a save destination specified by a scene number, and by accepting a setting of a save destination for data to be newly stored among secondary setting data linked from the scene data and storing the data in the accepted destination.

It should be noted that data that has not been modified from the time of loading among the secondary setting data does not need to be newly stored because only link data to the initial secondary setting data needs to be stored in saving. Therefore, the "data to be newly stored among secondary setting data" is secondary setting data that has been modified after the point of time a scene to be saved being loaded (or saved at the preceding time).

When a scene number of a save destination is selected at the operation module 50 and the store key 54 is pressed, the digital mixer displays, on a predetermined display screen of the display 11, a scene store dialog 100 as shown in FIG. 5 or FIG. 6.

The scene store dialog 100 has, as shown in FIG. 5 and FIG. 6, a scene name display box 101, a comment display box 102, an alphabet keyboard 103, a cancel key 104, an auto store display section 110, and a manual store display section 120.

The scene name display box 101 and comment display box 102 are display boxes which display the name of a scene to be saved and a comment to be saved with the scene respectively. The name of scene data is here assumed to be identical to the name of a scene. The display contents of these display boxes can be edited using the alphabet keyboard 103, and any alphabet string within a predetermined number of letters can be inputted.

FIG. 5 is a display example of directing a save using a new scene number, in which "SHINE" is inputted in the scene name display box 101, and "JUMP AND SHOUT" is inputted in the comment display box 102. In the initial state of a new scene number, however, the scene name and comment of current data are preferably displayed in the boxes, and the boxes may be brought into blank or a state with a predetermined initial string inputted.

The cancel key 104 is a switch for directing cancel of a save, and a press of the key (including, of course, placing a pointer at a right position by a mouse or the like and clicking, or touching a touch panel) erases the scene store dialog 100 to cancel the save of a scene.

The auto store display section 110 is a display section which displays an auto store key 117 that is an automatic save switch for directing execution of an automatic save of a scene, and the number and name of each secondary setting data when an automatic save is executed. Numbers of unit data, patch data, and name data when an automatic save is executed are displayed in a unit data number display box 111, a patch data number display box 112, and a name data number display box 113, respectively. Names of the unit data, patch data, and name data when the automatic save is executed are displayed in a unit data name display box 114, a patch data name display box 115, and a name data name display box 116, respectively.

In FIG. 5, hatchings are given to the display boxes associated with the patch data and name data, which represents that these data do not need to be newly stored and thus the number and name of link destination data are displayed as they are. Incidentally, actual display is preferably achieved by misty display (being displayed with mist thereover) or half-luminescence display.

There is no hatching given to display boxes associate with the unit data, which represents that the unit data has been modified and thus needs to be newly stored. A number and name are automatically set and displayed. The number of secondary setting data that needs to be newly stored is preferably set by searching unoccupied numbers and, for example, assigning a smallest number of the unoccupied numbers thereto. A name identical to a scene name should be preferably displayed, so that when the scene name is modified after display of the scene store dialog 100, the name of the secondary setting data is preferably also modified according thereto.

The manual store display section 120 is a display section which displays a manual store key 127 that is a manual save switch for directing execution of a manual save of a scene, and the name and save destination of each secondary setting data when a manual save is executed. Display boxes 121 to 126 correspond to the display boxes 111 to 116 of the auto store display section 110. However, since the save destination and name are not automatically set in the manual save, a mark "??" representing that the save destination is undetermined is displayed in the unit data number display box 121, and the unit data name display box 122 is made blank.

FIG. 6 shows a display example when there is a direction of a save into an existing scene number. In this case, since secondary setting data to be saved is written over secondary setting data linked from a save destination scene if there is no particular direction of modification, an overwrite destination number is displayed in the unit data number display boxes of both the auto store display section 110 and the manual store display section 120. It should be noted that FIG. 6 shows an example in which the scene name has been modified from an original name to "CORNER", accompanying which the display in the unit data name display box 114 of the auto store display section 110 has been modified to "CORNER," but the display in the unit data name display box 124 of the manual store display section 120 keeps an initial one "EDGE."

The processing of displaying the scene store dialog 100 as described above is one shown in FIG. 7. Upon pressing the store key 54 shown in FIG. 4, the CPU 15 starts the processing shown in a flowchart of FIG. 7.

In step S1, a scene number specified as a save destination at the operation module 50 is first stored in a register. It should be noted that the contents of the register should be kept stored, even when the processing in the flowchart of FIG. 7 is ended, until the scene store dialog 100 is erased.

Subsequently, in step S2, frame and key portions of the scene store dialog 100, that is, portions other than the display boxes 101, 102, 111 to 116, and 121 to 126 are displayed on the display 11. At this point of time, displayed keys are effective and can be pressed.

Then, the flow proceeds to step S3, in which the name and comment of a scene of current data are displayed in the scene name display box 101 and comment display box 102, respectively.

Then, the flow proceeds to step S4, in which it is determined whether the scene number of a save destination is a new scene number. If it is not, the flow proceeds to step S5, in which unit data box display routine A shown in FIG. 8 is performed.

In this routine, in step S21, it is determined first whether the unit data has been modified, that is, whether the unit data needs to be newly saved. If there is no need, the flow proceeds to step S22, in which the number and name of unit data linked from the scene data in the current memory are mistily displayed respectively in the unit data number display boxes 111 and 121 and the unit data name display boxes 114 and 124 of the auto store display section 110 and manual store display section 120, and the flow returns to the main routine. If the unit data needs to be newly stored in step S21, the flow proceeds to step S23, in which the number and name of unit data linked from the scene data in the current memory are normally displayed respectively in the unit data number display boxes 111 and 121 and the unit data name display boxes 114 and 124 of the auto store display section 110 and manual store display section 120, and the flow returns to the main routine.

The explanation will be returned to FIG. 7. After the processing in step S5 is ended, the flow proceeds to steps S6 and S7 in sequence for execution of the patch data box display routine A and name data box display routine A, which are ones formed by replacing the portion "unit" of the unit data box display routine A shown in FIG. 8 with "patch" and "name" respectively, and thus detailed explanation thereof will be omitted.

Ending of the processing in step S7 completes display of the scene store dialog 100, thereby ending the processing of the flowchart of FIG. 7.

On the other hand, if the scene number is a new scene number in step S3, the flow proceeds to step S8, in which the unit data box display routine B shown in FIG. 9 is performed.

In this routine, in step S31, it is determined first whether the unit data has been modified, that is, whether the unit data needs to be newly saved. If there is no need, the flow proceeds to step S32, in which the number and name of unit data linked from the scene data in the current memory are mistily displayed respectively in the unit data number display boxes 111 and 121 and the unit data name display boxes 114 and 124 of the auto store display section 110 and manual store display section 120, and the flow returns to the main routine.

If the unit data needs to be newly saved in step S31, the flow proceeds to step S33 because a user needs to specify a save destination in a manual save, in which the mark "??" representing that the save destination is undetermined is normally displayed in the unit data number display box 121 of the manual store display section 120.

Then, the flow proceeds to step S34, in which unoccupied numbers that are unused as numbers of unit data are searched. Then, if there is an unoccupied number, the flow proceeds to step S38, in which the unoccupied number is normally displayed in the unit data number display box 111 of the auto store display section 110 and set it as a number of the unit data when executing an automatic save, and the flow returns to the main routine. It should be noted that, for example, a smallest number of unoccupied numbers is preferably displayed in step S38.

In step S35, if there is no unoccupied number, a save destination cannot be automatically set, thus failing an automatic save cannot be performed. Hence, the flow proceeds to step S36, in which a mark "--" representing the above fact is normally displayed in the unit data number display box 111 of the auto store display section 110, disabling the auto store key 117 to prevent it from being pressed in step S37, and the flow returns to the main routine.

It should be noted that if the determination in step S31 is YES, display processing of the unit data name display boxes 114 and 124 is not performed, thus leaving these display boxes blank.

It is adoptable that when there is no unoccupied number in step S35, a message such as "--DATA FULL--" or the like may be displayed in the unit data name display box 114.

The explanation will be returned to FIG. 7. After the processing in step S8 is ended, the flow proceeds to steps S9 and S10 in sequence for execution of the patch data box display routine B and name data box display routine B, which are ones formed by replacing the portion "unit" of the unit data box display routine B shown in FIG. 9 with "patch" and "name" respectively, and thus detailed explanation thereof will be omitted.

Ending of the processing in step S10 completes display of the scene store dialog 100, thereby ending the processing of the flowchart of FIG. 7.

The above-described processing allows the scene store dialog 100 as shown in FIG. 5 or FIG. 6 to be displayed on the display 11. When the scene name is modified after display of the scene store dialog 100, the name and display of secondary setting data in an auto save are modified to be identical thereto. This processing should be performed by the CPU 15.

When the user presses the auto store key 117 after completion of display of the scene store dialog 100, the CPU 15 starts the processing shown in FIG. 10 to execute an automatic save.

In step S41, it is determined first whether any secondary setting data has been modified, that is, whether there is secondary setting data to be newly stored. If there is one, the flow proceeds to step S42, in which modified secondary setting data, that is, secondary setting data to be newly stored among current data is given a number and name displayed at the auto store display section 110 and stored in a save destination specified by the number of a storage region of secondary setting data in the setting data memory.

Then, the flow proceeds to step S43, in which, as for the modified secondary setting data, after the link destination of the scene data stored in the current memory is changed to a number displayed at the auto store display section 110, the scene data in the current memory is given the name displayed in the scene name display box 101 and stored in the setting data memory together with the comment displayed at the comment display section 102, as the scene data of the scene number stored in the register in the processing in step S1 of FIG. 7. If there is no modification in step S41, the flow proceeds direct to step S43. Thereafter, in step S44, the scene store dialog 100 is erased, and the processing is ended.

In the processing from step S41 to step S43 of the above, the CPU 15 functions as an automatic saver.

On the other hand, when the user presses the manual store key 127 after the completion of display of the scene store dialog 100, the CPU 15 starts the processing shown in FIG. 11 to execute a manual save. This processing is similar to the processing explained using FIG. 10 other than that the processing in step S45 is performed in place of that in step S42. Only the processing in step S45 and the processing in step S43 influenced thereby will be explained.

In step S45, a save destination specification dialog 200 as shown in FIG. 12 is displayed on the display 11 for modified secondary setting data, that is, secondary setting data to be newly stored, specification of a number and name to be set to the secondary setting data is accepted, the number and name are given to the secondary setting data, and the data is stored in a save destination specified by the number in the setting data memory.

The save destination specification dialog 200 includes a number and name specification section 201, an alphabet keyboard 202, a decision key 203, and a cancel key 204. The number and name specification section 201 is for specifying a number and name of secondary setting data to be saved. The number and name specification section 201 has a pull down menu so that a number and name can be selected from among existing ones and specified, and can also be specified by inputting a string through the alphabet keyboard 202.

After the specification of the number and name, when the decision key 203 is pressed, the CPU 15 gives the specified number and name to the secondary setting data, and stores it in the save destination specified by the number in the storage region of the secondary setting data in the setting data memory. When the cancel key 204 is pressed, the CPU 15 erases the save destination specification dialog 200 to cancel the processing in FIG. 11.

Although FIG. 12 shows an example showing the save destination specification dialog 200 for unit data, a similar dialog can be used for patch data and name data. After necessary dialogs of them are displayed one by one to accept specification of numbers and names, and saves of all the secondary setting data need to be saved are ended, the processing in step S45 is finished.

In subsequent step S43, after a link destination of scene data stored in the current memory is modified in accordance with each number specification at the save destination specification dialog 200 opened in step S45, the scene data is stored in the setting data memory as the scene data of the scene number of the save destination stored in the register in the processing in step S1 of FIG. 7.

In the processing in steps S41, S43, and S45 of the routine shown in FIG. 11, the CPU 15 functions as a manual saver.

As described above, in the manual save, when all of the unit data, patch data, and name data need to be saved, the save destination specification dialog is displayed thee times, and the user needs to specify a number and name each time.

In this digital mixer, however, the automatic save allows an appropriate number to be automatically given to secondary setting data only by pressing one key in the scene store dialog to specify a save destination for saving a scene. This eliminates the user having to set a save destination of each secondary setting data, so that the number of operations necessary for directing storage of setting data can be reduced to improve operability.

Besides, in the automatic save, setting of a name of secondary setting data identical to that of primary setting data also allows a suitable name to be automatically set. Giving a name also to secondary setting data enables grasp of contents to some extent from the name, which facilitates management, but input of a name is troublesome and causes reduced operability. Accordingly, the automatic setting of a suitable name greatly contributes to improved operability.

Display of the auto store key 117 and a save destination of secondary setting data in executing an automatic save on the same display screen allows the user, in the automatic save, to confirm where secondary setting data is saved before directing execution of the automatic save, thus preventing the data from being saved in an inconvenient place in the executed automatic save.

In this digital mixer, the manual store key 127 is also displayed on the same display screen to easily select not only an automatic save but also a manual save, so that the user can immediately direct execution of a manual save if he or she is not satisfied with the save destination in an automatic save. This widens the user's choice and can further improve the operability of the device.

In the meantime, in the above-described mixer, when a scene number is specified and a store of a scene is directed, displays at the auto store display section 110 and manual store display section 120 of the scene store dialog 100 are made different as shown in FIG. 5 and FIG. 6 in accordance with whether or not the scene number is of an existing scene (step S4 of FIG. 7). However, irrespective of whether or not it is of an existing scene, the display may be preformed in a form for a not existing scene as described using FIG. 5, steps S8 to S10 of FIG. 7, and FIG. 9.

In other words, irrespective of whether or not a scene number of a store destination is of an existing scene, if secondary setting data in the current memory has been modified, the mark "??" may be normally displayed in the number display box associated with the secondary setting data of the manual store display section 120 in the scene store dialog 100 as described on step S33 of FIG. 9, and a smallest number of unoccupied numbers may be displayed in the number display box associated with the secondary setting data of the auto store display section 110 as described on step S38 of FIG. 9.

It should be noted that if the secondary setting data in the current memory has not been modified, same processing is essentially performed irrespective of whether or not the scene number is of an existing scene as described on step S22 of FIG. 8 and step S32 of FIG. 9, and thus even this case is not different from the above-described example.

In the modification as described above, even in an auto store with a number of an existing scene, secondary setting data is saved with a new number if it has been modified, so that the modification does not influence the existing secondary setting data, which can prevent influence on other scene data having link to the secondary setting data.

Besides, it is also adoptable to configure the above-described mixer such that execution of an auto save can be directed by pressing again the store key 54 of the operation module 50 after display of the scene store dialog 100 in place of pressing the auto store key 117 in the scene store dialog 100. This configuration enables a save of a scene only by pressing a same key twice, thus reducing a necessary amount of operation to further improve the operability. It is more preferable to make the active/inactive state of this function settable.

The digital mixer has been described in the foregoing as an example of an audio signal processing device of the invention. It is needless to say that the invention is also applicable to various audio signal processing devices that including an electronic musical instrument, composed of a mixer, an effector, a recorder, a synthesizer, and combination thereof. In this case, contents of portions among setting data to be secondary setting data, the number of secondary setting data, and so on may be decided as necessary in accordance with characteristics of a device, as a matter of course. The effects of the invention become more prominent in a case with a larger number of secondary setting data.

As has been described, according to the audio signal processing device of the invention, a scene can be saved by an automatic save by automatically giving a suitable number thereto to specify a save destination, which eliminates a user having to set a save destination of each secondary setting data, so that the number of operations necessary for directing storage of setting data can be reduced to improve operability.

What is claimed is:

1. An audio signal processing device which processes audio signals and outputs the audio signals, comprising:

a first memory for storing current data being setting data representing a current status of said device;

a controller for controlling said device based on the current data;

a second memory for storing the setting data as primary setting data and secondary setting data linked from the primary setting data;

an automatic saver for executing an automatic save, when storing the setting data in said second memory, by storing the primary setting data in a specified save destination in said second memory, and by automatically setting a save destination for data to be newly stored among the secondary setting data linked from the primary setting data and storing the data in said second memory;

a manual saver for executing a manual save, when storing the setting data in said second memory, by storing the primary setting data in a specified save destination in said second memory, and by accepting a setting of a save destination for data to be newly stored among the secondary setting data linked from the primary setting data and storing the data in the accepted save destination in said second memory;

an automatic save switch for directing execution of the automatic save; and a manual save switch for directing execution of the manual save.

2. The audio signal processing device according to claim 1, further comprising:

a display; and a display controller for causing said display to display on a same display screen said automatic save switch and the save destination of the secondary setting data when the automatic save is directed.

3. The audio signal processing device according to claim 1, further comprising:

a display; and a display controller for causing said display to display the save destination of the secondary setting data when the automatic save and/or the manual save are/is directed, wherein the display is performed in a different form, depending on whether or not the secondary setting data is to be newly stored.

4. The audio signal processing device according to claim 1, further comprising:

a display; and a display controller for causing said display to display the save destination of the secondary setting data when the automatic save and/or the manual save are/is directed, wherein a different save destination is displayed as the save destination of the secondary setting data, in accordance with whether the specified save destination of the primary setting data is new or existing.

5. The audio signal processing device according to claim 4, wherein in the case of the specified save destination of the primary setting data being existing, save destination of the secondary setting data to be newly stored is set at a destination from which a secondary setting data linked from the primary setting data is loaded.

6. The audio signal processing device according to claim 1, further comprising:

a display; and a display controller for causing said display to display the save destination of the secondary setting data when the automatic save and/or the manual save are/is directed, wherein one of unoccupied save destinations is displayed as a save destination when the automatic save is directed, and information that the save destination is undetermined is displayed instead of a save destination when the manual save is directed, for secondary setting data to be newly stored.

7. The audio signal processing device according to claim 1, wherein the data to be newly stored among the secondary setting data is one which has been modified before it is stored in the second memory among the secondary setting data stored in the first memory.

8. An audio signal processing device which processes audio signals and outputs the audio signals, comprising:

a display;

a first memory for storing current data being setting data representing a current status of said device;

a controller for controlling said device based on the current data;

a second memory for storing the setting data as primary setting data and secondary setting data linked from the primary setting data;

an automatic saver for executing an automatic save, when storing the setting data in said second memory, by storing the primary setting data in a specified save destination in said second memory, and by automatically setting a save destination for data to be newly stored among the secondary setting data linked from the primary setting data and storing the data in said second memory; and a display controller for causing said display to display said automatic save switch for directing execution of the automatic save and a save destination of the secondary setting data when the automatic save is directed.

9. The audio signal processing device according to claim 8, further comprising:

a specification acceptor for accepting specification of a name of the primary setting data; and a setting executor for setting, when the name of the primary setting data is specified, a name of secondary setting data to be stored in said automatically set save destination identical to the name of the primary setting data being a target of the automatic save.

10. The audio signal processing device according to claim 8, wherein when said display displays the save destination of the secondary setting data, the destination is displayed in a different form, depending on whether or not the secondary setting data is to be newly stored.

11. The audio signal processing device according to claim 8, wherein when said display displays the save destination of the secondary setting data, a different save destination is displayed, in accordance with whether the specified save destination of the primary setting data is new or existing.

12. The audio signal processing device according to claim 11, wherein in the case of the specified save destination of the primary setting data being existing, save destination of the secondary setting data to be newly stored is set at a destination from which a secondary setting data linked from the primary setting data is loaded.

13. The audio signal processing device according to claim 8, wherein when said display displays the save destination of the secondary setting data, one of unoccupied save destinations is displayed as a save destination for secondary setting data to be newly stored.

14. The audio signal processing device according to claim 8, wherein the data to be newly stored among the secondary setting data is one which has been modified before it is stored in the second memory among the secondary setting data stored in the first memory.

* * * * *